US005938486A

United States Patent [19]

Durand-Cochet et al.

[11] Patent Number: 5,938,486

[45] Date of Patent: Aug. 17, 1999

[54] FEMALE ELECTRICAL CONTACT MEMBER AND ELECTRICAL CONNECTOR HOUSING MEMBER ADAPTED TO RECEIVE A MEMBER OF THIS KIND

[75] Inventors: Fabrice Durand-Cochet, Rambouillet; Stéphane Barnabe, Chaville, both of France

[73] Assignee: Connecteurs Cinch, Montigny Le Bretonneux, France

[21] Appl. No.: 09/048,509

[22] Filed: Mar. 26, 1998

[30] Foreign Application Priority Data

Apr. 16, 1997 [FR] France ..... 97 04681

[51] Int. Cl.[6] ..... H01R 4/48

[52] U.S. Cl. ..... 439/839; 439/745

[58] Field of Search ..... 439/839, 843, 439/846

[56] References Cited

U.S. PATENT DOCUMENTS

| | | | |
|---|---|---|---|
| 4,168,880 | 9/1979 | Tesch . | |
| 4,540,234 | 9/1985 | Konnemann et al. . | |
| 4,550,972 | 11/1985 | Romak | 439/843 |
| 5,591,051 | 1/1997 | Ittah | 439/839 |

FOREIGN PATENT DOCUMENTS

| | | |
|---|---|---|
| 0 108 878 | 5/1984 | European Pat. Off. . |
| 0 677 890 | 10/1995 | European Pat. Off. . |
| 2 392 510 | 12/1978 | France . |
| 44 32 921 | 3/1995 | Germany . |

*Primary Examiner*—Neil Abrams
*Assistant Examiner*—J. F. Duverne
*Attorney, Agent, or Firm*—Pearne, Gordon, McCoy & Granger LLP

[57] ABSTRACT

A female electrical contact member comprises a body with connecting members at one end for connecting it to an electrical conductor, such as crimping lugs, and at the other end a series of elastic lugs for gripping a cylindrical male member and extending from a cylindrical ring connected to the connecting members by a profiled part. It is completed by an outer sleeve having a bush inserted in and fixed to the cylindrical ring and a sleeve with cut-out elastic tongues which cooperate with the elastic lugs to strengthen their action. The outer sleeve has retaining members which cooperate with a shoulder in a passage of a connector housing member and receive the female member. The part of the body including the elastic lugs has a diameter less than that of the ring, the two parts being joined by a shoulder. The diameter of the sleeve of the outer sleeve is smaller than that of the bush, the two parts being joined by a shoulder. The sleeve has a rim at its free end opposite the bush and from which extend the retaining members which are bent towards the bush and extend as far as the vicinity thereof.

4 Claims, 4 Drawing Sheets

FIG. 2
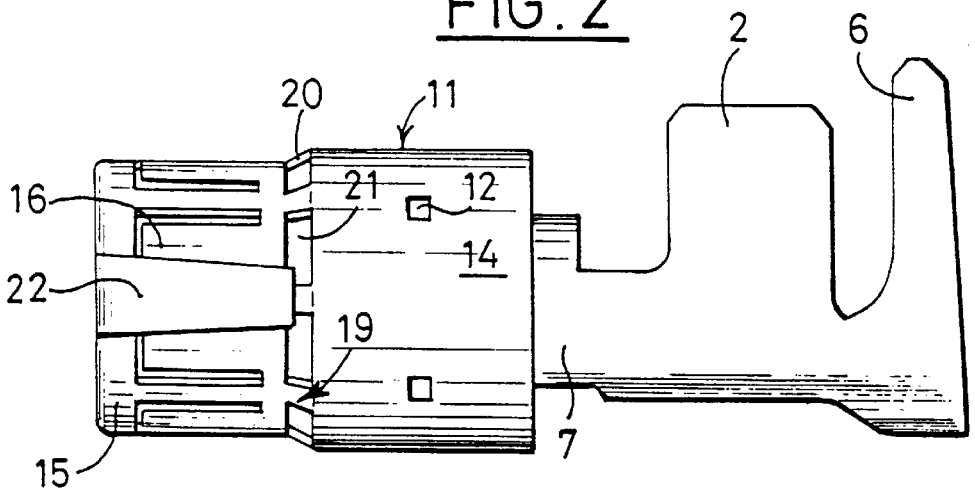
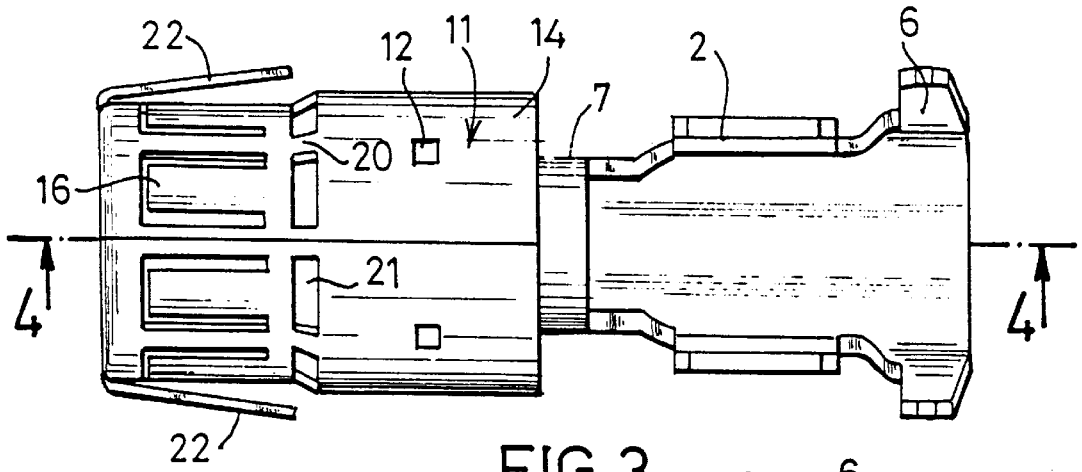
FIG. 3
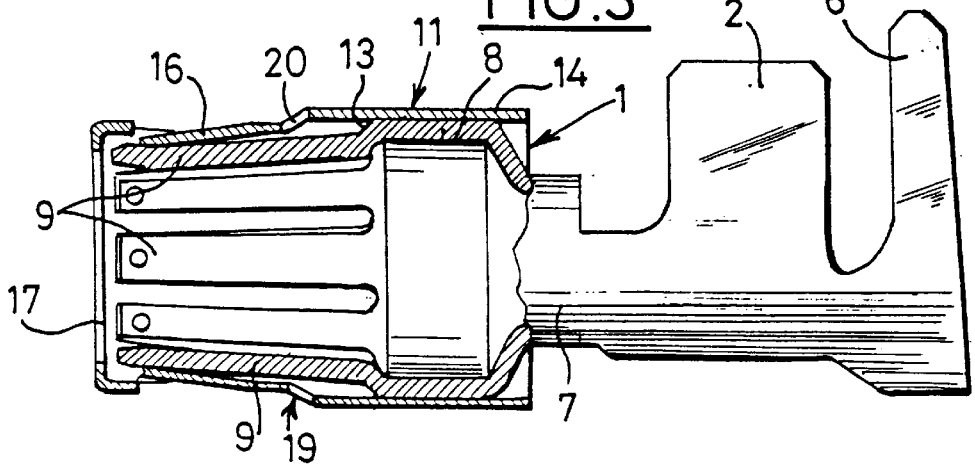
FIG. 4

FEMALE ELECTRICAL CONTACT MEMBER AND ELECTRICAL CONNECTOR HOUSING MEMBER ADAPTED TO RECEIVE A MEMBER OF THIS KIND

BACKGROUND OF THE INVENTION

1. Field of the Invention

The present invention concerns a female electrical contact member adapted to receive a cylindrical male member.

The invention also concerns an electrical connector housing member adapted to receive a female member of the above kind.

2. Description of the Prior Art

The invention concerns female electrical contact members comprising a body with means at one end for fixing them to an electrical conductor and a series of elastic lugs at the other end adapted to grip a male member and arranged in a substantially frustoconical shape. In this type of female member an outer sleeve is sleeved over and fixed to the body and includes elastic tongues cooperating with said elastic lugs to reinforce their elastic action and retaining members for immobilizing said member in a passage in a housing member.

The female members generally have an abutment at the rear adapted to cooperate with a shoulder in the passage in the housing, the part of the latter adapted to receive the outer sleeve having a diameter greater than that of said outer sleeve so that the retaining lugs can pass through this part on fitting them to cooperate with a corresponding shoulder.

An arrangement of the above kind has many disadvantages. It necessarily implies some play of the female member in its passage with the result that insertion of the corresponding male member can damage the female members.

Also, the abutment increases the length of the female member which leads to the use of a large quantity of material and increases the contact resistance, which is particularly important in the case of power contacts.

One aim of the invention is to remedy the above drawbacks.

SUMMARY OF THE INVENTION

A female electrical contact member in accordance with the invention comprises a body with means at one end for connecting it to an electrical conductor, such as crimping lugs, and at the other end a series of elastic lugs adapted to grip a cylindrical male member and extending from a cylindrical ring connected to the connecting members by a profiled part, the member being completed by an outer sleeve having a bush inserted in and fixed to the cylindrical ring and a sleeve with cut-out elastic tongues adapted to cooperate with the elastic lugs to strengthen their action, the outer sleeve having retaining members adapted to cooperate with a shoulder in a passage of a connector housing member and to receive the female member, wherein the part of the body including the elastic lugs has a diameter less than that of the ring, the two parts are joined by a shoulder, the diameter of the sleeve of the outer sleeve is smaller than that of the bush, the two parts are joined by a shoulder and the sleeve has a rim at its free end opposite the bush and from which extend the retaining members which are bent towards the bush and extend as far as the vicinity thereof.

By virtue of this arrangement the part of the passage adapted to receive the bush of the outer sleeve can have a diameter corresponding to that of the bush so that the female member can be fitted into the passage without significant play, the difference between the outside diameters of the bush and the sleeve being less than the thickness of the retaining members.

The outer sleeve has openings in line with its shoulder to facilitate deformation of the shoulder between the bush and the sleeve.

The bush of the outer sleeve has holes to facilitate welding it to the ring.

The invention also consists in an electrical connector housing member adapted to receive a female electrical contact member as claimed in any one of the preceding claims and comprising a series of passages each adapted to receive a female member, each passage having a rear end for insertion of the female member, an intermediate part in which the crimping lugs are accommodated, a housing for the bush and a cavity for the sleeve joined to the housing by a shoulder, wherein the front end of the passage includes a ring having an inside diameter corresponding to an inside diameter of that part of the body delimited by the elastic lugs and an outside diameter substantially corresponding to an outside diameter of the free end of the sleeve, the ring is joined to the housing member by radial webs and the housing has a diameter substantially equal to that of the bush.

In this way, the female member being held at the front, the abutment provided on the female member in the prior art can be dispensed with. The retaining members can easily be retracted with a tool passed through the openings between the radial webs in order to withdraw the female member from its passage.

The invention will now be described in more detail by way of example only with reference to a particular embodiment shown in the appended drawings.

BRIEF DESCRIPTION OF THE DRAWINGS

FIG. 2 is an elevation view of the female electrical contact member.

FIG. 3 is a plan view of the electrical contact ember from the preceding figures.

FIG. 4 is a view in section taken along the line 4—4 in FIG. 3.

DETAILED DESCRIPTION OF THE PREFERRED EMBODIMENT

Figure 1:
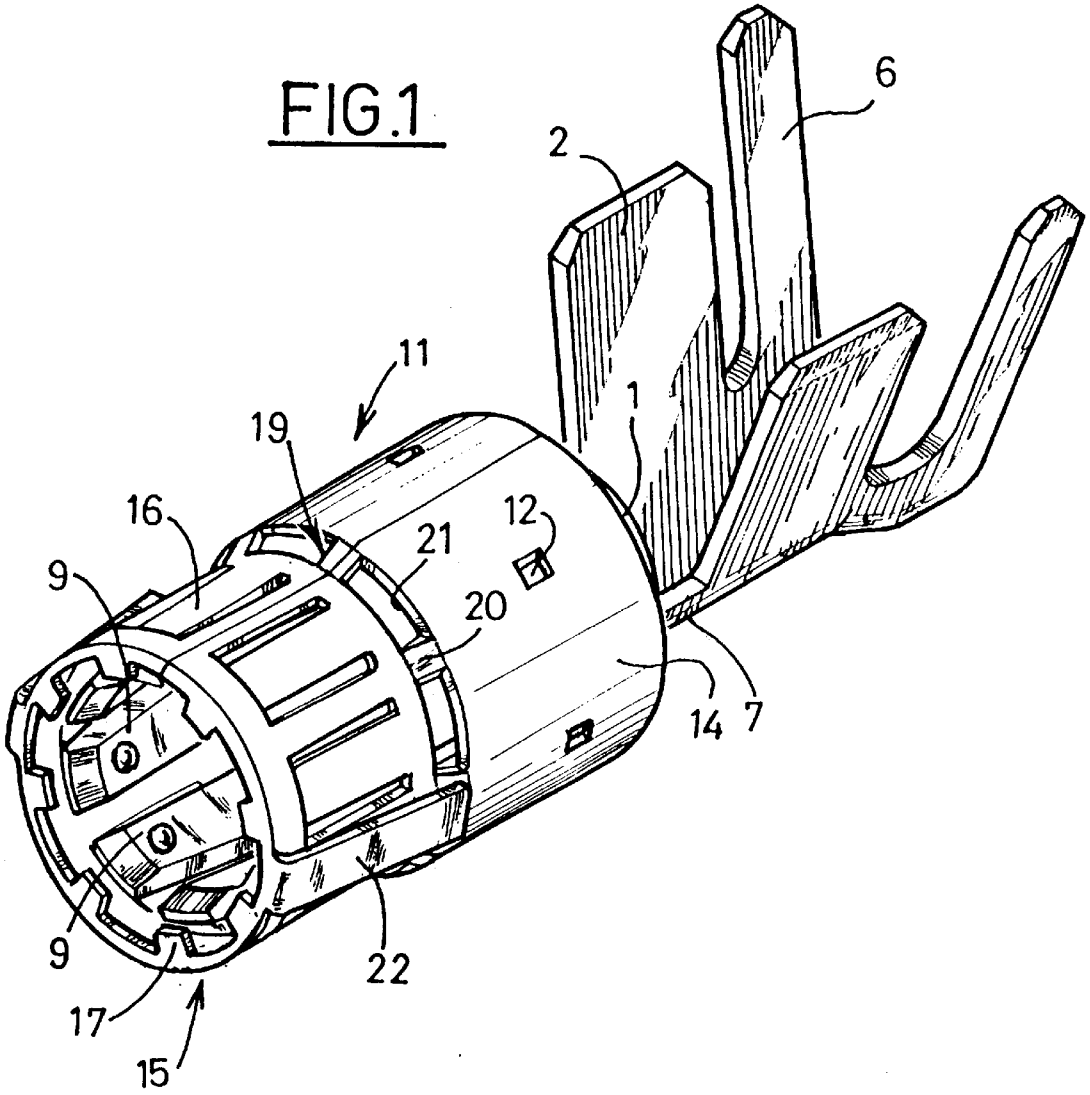
FIG. 1 is a perspective view of a female electrical contact member in accordance with the invention.

The female electrical contact member shown in the various figures has a body 1 with crimping lugs 2 at one end adapted to grip a bared end 3 of a conductor 4 and lugs 6 for gripping said conductor 4.

Near the lugs 2 the body 1 has a profiled part 7 extended by a cylindrical ring 8 terminating in a series of elastic lugs 9 adapted to grip a cylindrical male contact member (not shown).

The part of the body 1 including the elastic lugs 9 is substantially frustoconical in shape with the larger base joined to the ring 8 by a shoulder 13, the diameter of the ring 8 being greater than that of said larger base.

The female member is completed by an outer sleeve 11 which has at one end a bush 14 sleeved over the ring 8 and incorporating holes 12 enabling it to be welded to the latter.

The bush 14 is extended by a sleeve 15 of smaller diameter with a series of cut-out elastic tongues 16 cooperating with the lugs 9.

The sleeve 15 terminates at a rim 17 adapted to protect the lugs 9 and has two retaining strips 22 offset by 180° directed towards the bush 14.

The outer sleeve 11 is made from a metal having a high modulus of elasticity and the body 1 is made from a material that is a very good conductor of electricity so that it can carry electrical currents in excess of 100 A.

To facilitate bending and rolling the outer sleeve, the bush 14 is joined to the sleeve 15 by strips 20 delimited by openings 21 in the thickness of the material constituting the outer sleeve, a shoulder 9 being formed in line with the strips 20.

The difference between the diameter of the sleeve 15 and the diameter of the bush 14 is less than the thickness of the retaining strips 22.

Figure 6:
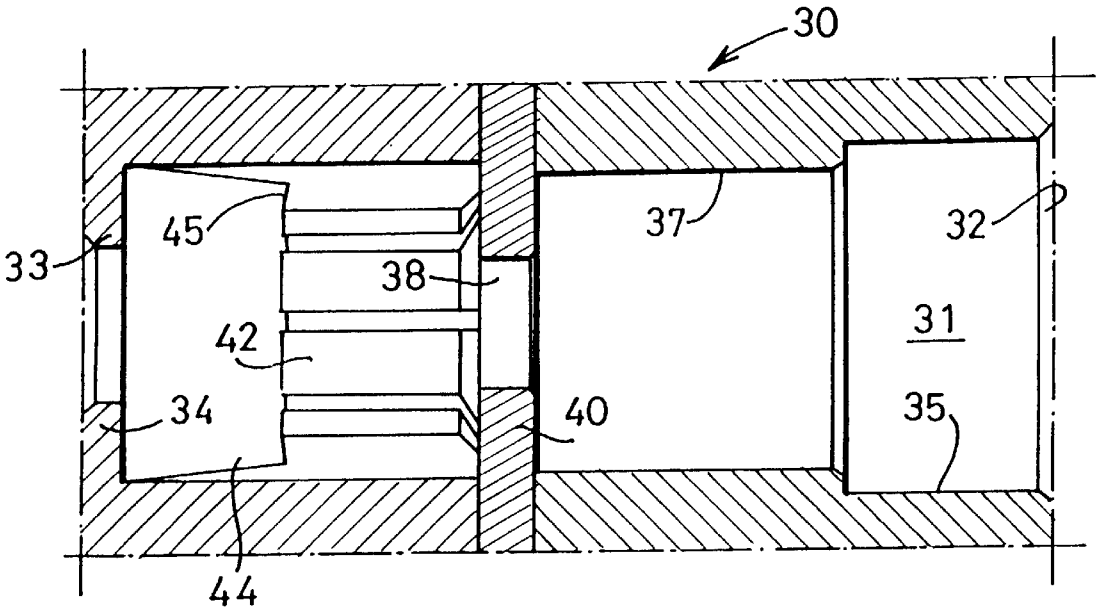
FIG. 6 is a sectional view taken along the line 6—6 in FIG. 5.
Figure 5:
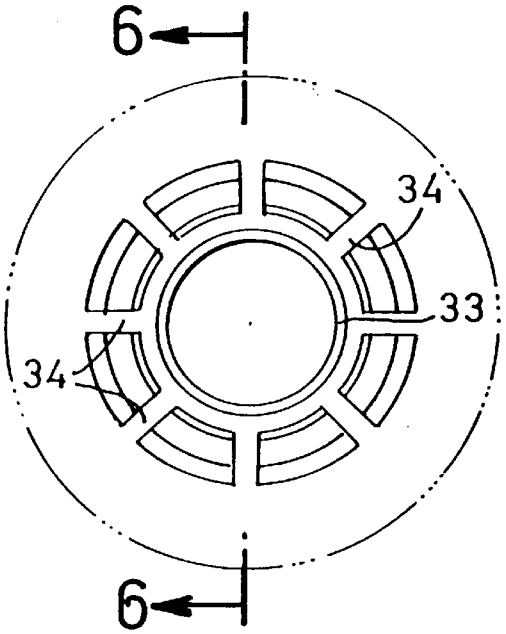
FIG. 5 shows end on a portion of a housing member adapted to receive a female member in accordance with the invention.
Figure 7:
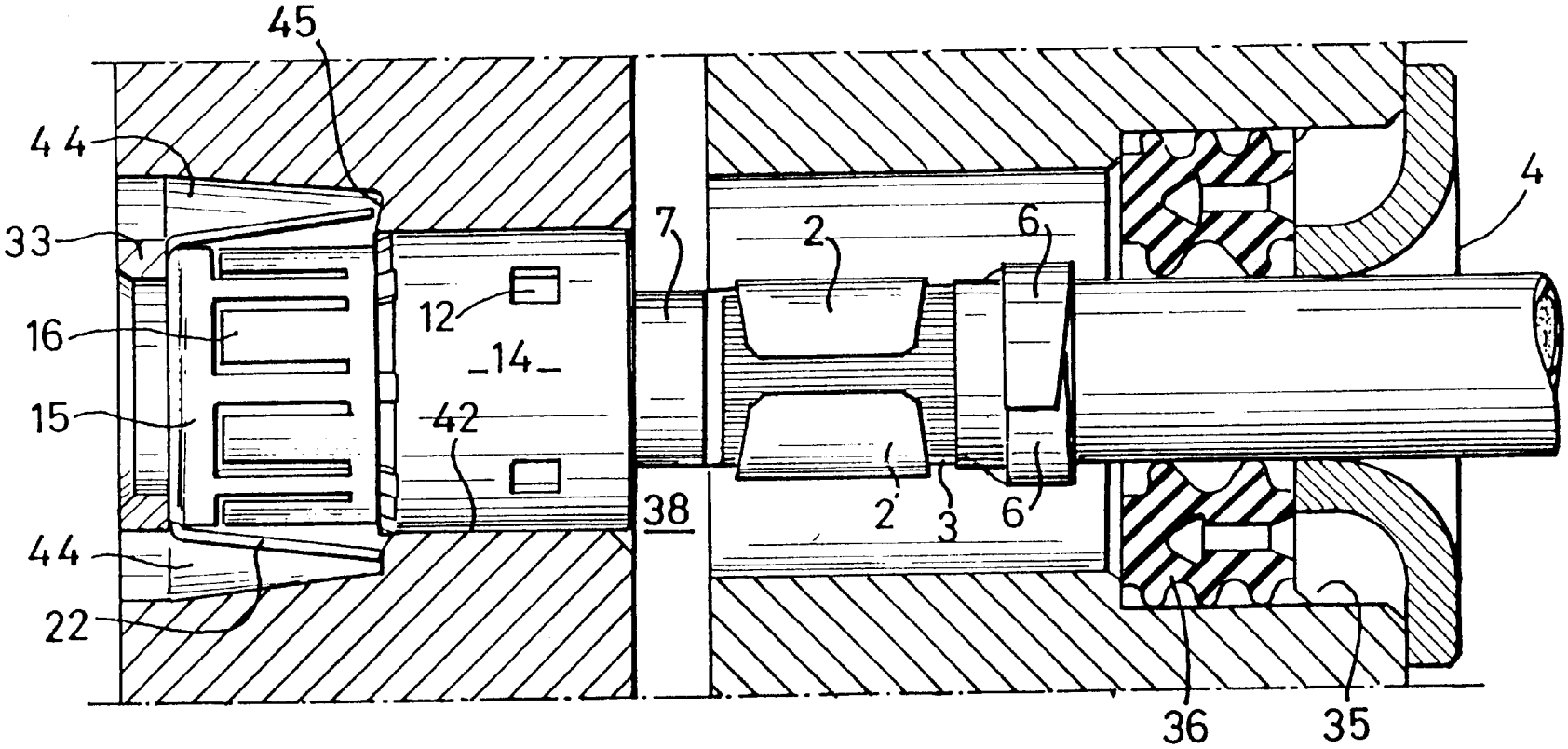
FIG. 7 is a sectional view corresponding to FIG. 6 showing the female member in place in the housing member.

FIGS. 5 and 6 show part of a housing member 30 adapted to receive a member in accordance with the invention.

This housing member includes a series of passages 31 having a female member insertion end 32 and the other end of which is provided with a retaining ring 33 for said members joined to the corresponding wall by radial webs 34.

Each passage 31 has a rear end 35 into which the conductor 4 extends and in which is housed a seal 36, an intermediate part 37 in which the lugs 2 and 6 are housed, a transverse slot 38 in which the profiled part 7 is inserted and which is adapted to receive a locking key 40, a housing 42 corresponding to the bush 14 and a cavity 44 adapted to receive the sleeve 15 and joined to the housing 42 by a shoulder 45.

Accordingly, when the female electrical contact member is fitted into the passage 31 to insert the sleeve 15 into the housing 42 the retaining strips 22 retract elastically and then return to their original position to cooperate with the shoulder 45. The female electrical contact member is therefore locked perfectly into the passage 31 because it bears against the ring 33 and is held by the retaining strips 22 which abut on the shoulder 45 and the bush 14 is inserted with minimum play into the housing 42.

The female member can easily be withdrawn by inserting a tool through the openings between the webs 34 to depress the strips 22 in order to disengage them from the shoulder 45.

Of course, the invention is not limited to the embodiment shown that has just be described. Many modifications of detail can be made thereto without departing from the scope of the invention.

There is claimed:

1. A female electrical contact member comprising a body with connecting members at one end for connecting it to an electrical conductor, such as crimping lugs, and at the other end a series of elastic lugs adapted to grip a cylindrical male member and extending from a cylindrical ring connected to said connecting members by a profiled part, said member being completed by an outer sleeve having a bush inserted on and fixed to said cylindrical ring and a sleeve with cut-out elastic tongues adapted to cooperate with said elastic lugs to strengthen their action, said outer sleeve having retaining members adapted to cooperate with a shoulder in a passage of a connector housing member and to receive said female member, wherein the part of said body including said elastic lugs has a diameter less than that of said ring, said two parts are joined by a shoulder, the diameter of said sleeve of said outer sleeve is smaller than that of said bush, said two parts are joined by a shoulder and said sleeve has a rim at its free end opposite said bush and from which extend said retaining members which are bent towards said bush and extend as far as the vicinity thereof.

2. The female electrical contact member claimed in claim 1 wherein said outer sleeve includes openings in line with said shoulder therein.

3. The female electrical contact member claimed in claim 1 wherein said bush of said outer sleeve includes holes to facilitate welding it to said ring.

4. An electrical connector housing member adapted to receive a female electrical contact member as claimed in any one of the preceding claims and comprising a series of passages each adapted to receive a female member, each passage having a rear end for insertion of said female member, an intermediate part in which said crimping lugs are accommodated, a housing for said bush and a cavity for said sleeve joined to said housing by a shoulder, wherein the front end of said passage includes a ring having an inside diameter corresponding to an inside diameter of that part of said body delimited by said elastic lugs and an outside diameter substantially corresponding to an outside diameter of the free end of said sleeve, said ring is joined to said housing member by radial webs and said housing has a diameter substantially equal to that of said bush.

* * * * *

UNITED STATES PATENT AND TRADEMARK OFFICE

CERTIFICATE OF CORRECTION

PATENT NO. : 5,938,486

DATED : August 17, 1999

INVENTOR(S) : Durand-Cochet et al.

It is certified that error appears in the above-indentified patent and that said Letters Patent is hereby corrected as shown below:

Column 2, Line 41, delete "ember" and insert --member--.

Column 3, Line 17, delete "9" and insert --19--.

Signed and Sealed this

Fourth Day of April, 2000

*Attest:*

*Attesting Officer*

Q. TODD DICKINSON

*Director of Patents and Trademarks*